US009102385B1

(12) United States Patent
Borne

(10) Patent No.: US 9,102,385 B1
(45) Date of Patent: Aug. 11, 2015

(54) DINGHY TOWING BRAKE

(71) Applicant: George F Borne, Grand Bay, AL (US)

(72) Inventor: George F Borne, Grand Bay, AL (US)

( * ) Notice: Subject to any disclaimer, the term of this patent is extended or adjusted under 35 U.S.C. 154(b) by 0 days.

(21) Appl. No.: 14/450,230

(22) Filed: Aug. 2, 2014

Related U.S. Application Data

(60) Provisional application No. 61/862,070, filed on Aug. 4, 2013.

(51) Int. Cl.
*B63B 21/48* (2006.01)
*B63B 21/56* (2006.01)

(52) U.S. Cl.
CPC ..... *B63B 21/56* (2013.01); *B63B 21/48* (2013.01)

(58) Field of Classification Search
CPC ..... B63B 21/24; B63B 21/48
USPC ..... 114/244, 253, 294, 311
See application file for complete search history.

(56) References Cited

U.S. PATENT DOCUMENTS

| | | | | |
|---|---|---|---|---|
| 1,117,189 | A * | 11/1914 | Jackson | 114/311 |
| 2,536,681 | A | 1/1951 | Frieder, et al. | |
| 3,296,996 | A | 1/1967 | Miller | |
| 4,481,900 | A | 11/1984 | Rutten et al. | |
| 4,733,628 | A | 3/1988 | Baughman | |
| 4,958,583 | A | 9/1990 | Renouard | |
| 5,062,379 | A | 11/1991 | Cherry | |
| 5,463,971 | A * | 11/1995 | Abernethy | 114/311 |
| 7,207,287 | B2 * | 4/2007 | Beech | 114/311 |

* cited by examiner

*Primary Examiner* — Lars A Olson
(74) *Attorney, Agent, or Firm* — George L Williamson

(57) ABSTRACT

Method and apparatus for a dinghy brake including a cone-like member having a smaller front end and a larger rear end connected in line between a towing boat and a towed dinghy in such a way that if the towing boat should slow or stop suddenly, the towed dinghy would be stopped from overtaking or colliding with the towing boat. The dinghy brake includes a cone-like central member comprising a plurality of panels connected inside a plurality of cords so that the apparatus can be tied or connected between the towing boat and the towed dinghy.

17 Claims, 2 Drawing Sheets

DINGHY TOWING BRAKE

RELATED APPLICATIONS

This application claims benefit of U.S. Provisional Application No. 61/862,070 filed Aug. 4, 2013.

BACKGROUND OF THE INVENTION

1. Field of the Invention

The present invention relates generally to boats and, more particularly, is concerned with a dinghy towing brake.

2. Description of the Related Art

Devices relevant to the present invention have been described in the related art, however, none of the related art devices disclose the unique features of the present invention.

In U.S. Pat. No. 3,296,996, dated Jan. 10, 1967. Miller disclosed a method and apparatus for slowing the forward speed of a towed submerged vessel. In U.S. Pat. No. 5,062,379 dated Nov. 5, 1991, Cherry disclosed a method and apparatus for controlling the speed of boats. In U.S. Pat. No. 2,536,681 dated Jan. 2, 1951, Frieder, et al., disclosed a sea anchor. In U.S. Pat. No. 4,481,900 dated Nov. 13, 1984, Rutten, et al., disclosed a sea anchor. In U.S. Pat. No. 4,733,628 dated Mar. 29, 1988, Baughman disclosed a recoverable sea anchor and method therefor. In U.S. Pat. No. 4,958,583 dated Sep. 25, 1990, Renouard disclosed a water ski safety apparatus.

While these devices may be suitable for the purposes for which they were designed, they would not be as suitable for the purposes of the present invention as hereinafter described.

SUMMARY OF THE PRESENT INVENTION

The present invention discloses a dinghy brake including a cone-like member having a smaller front end and a larger rear end connected in line between a towing boat and a towed dinghy in such a way that if the towing boat should slow or stop suddenly, the towed dinghy would be stopped from overtaking or colliding with the towing boat. The present invention includes a cone-like central member comprising a plurality of panels connected inside a plurality of cords so that the apparatus can be tied or connected between the towing boat and the towed dinghy.

An object of the present invention is to provide a brake to a towed dinghy so that the dinghy is prevented from overtaking and colliding with a towing boat should the towing boat slow or stop suddenly. A further object of the present invention is to provide a dinghy towing brake having the panels constructed in such a way that the individual members of the panel have a concave shape relative to the central axis of the cone so that the cone maintains itself in an open position when submerged. A further object of the present invention is to provide a dinghy tow brake which can be easily used by an operator. A further object of the present invention is to provide a dinghy tow brake which can be relatively easily and cheaply manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
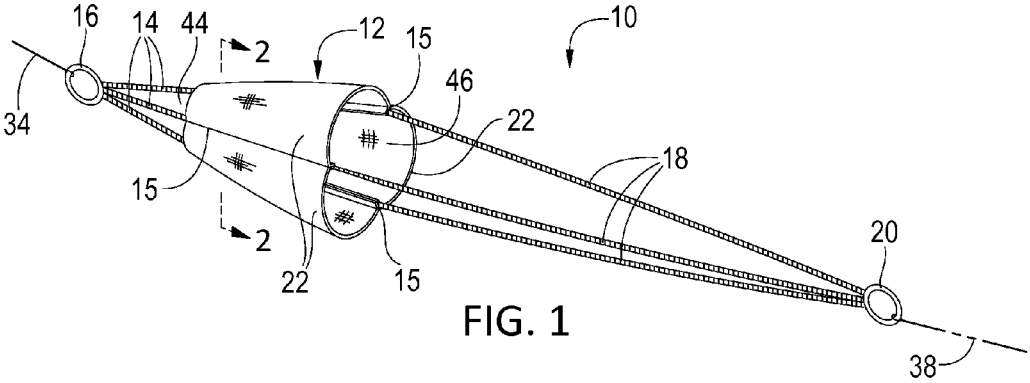
FIG. 1 is a perspective view of the present invention.

With regard to reference numerals used, the following numbering is used throughout the drawings.

10 present invention
12 cone/braking member
14 front cords
15 cord
16 front loop
20 rear loop
22 fabric panel
22*a* fabric panel
22*b* fabric panel
22*c* fabric panel
24 seam
26 seam
28 seam
30 stitching
32 towing boat
34 towing line from boat
36 dinghy
38 towing line to dinghy
39 towing line loop to dinghy
40 centerline
42 concave cross section
44 smaller end
46 larger end
48 water surface

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. Figures I through 7 illustrate the present invention wherein a dinghy towing brake is disclosed and which is generally indicated by reference number 10.

Figure 4:
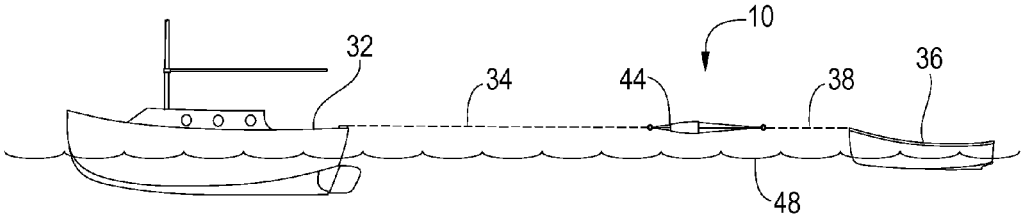
FIG. 4 is an illustration showing the present invention in operative connection wherein the towing boat is moving forward and towing the dinghy with the cone above water.

Turning to FIG. 1, therein is shown the present invention 10 having a truncated cone shaped braking member 12 attached on the inside of three cords 15 having first and second ends 14, 18 so that the larger end 46 of the cone is oriented toward the dinghy as shown in FIG. 4. The first end of the cords 14 are joined at a first loop or ring 16 and the second end of the cords 18 are joined at a second loop or ring 20. The loops 16, 20 could be formed by forming or tying a small loop in the ends of the elongated flexible members or cords 15 or by attaching a separate ring. Braking member 12 comprises a plurality of panels 22 and has a smaller end 44 and a larger end 46. The length of the present invention 10 is about one-fourth to one-third the length of the dinghy 40. The present invention 10 has at least three cords 14, 18 of equal lengths arranged in a parallel fashion connected at the ends and forming a small loop or eye 16, 20 at each end wherein the loops or eyes are used to attach towing lines 34, 38. A towing line 34 on one end of the present invention 10 is attached to the towing boat 32 and the towing line 38 on the other end of the device is attached to the towed dinghy or boat 36 wherein the towing line 38 attached to the dinghy is slightly less than the length of the present invention 10. The towing line 34 attached to the boat is significantly longer and is expected to be at least 30 to 40 feet in length. Near the end of the present invention 10 that is attached to the boat, a fabric cone braking member 12 is attached to the inside of the three cords 14, 18 with the larger end 46 of the cone oriented toward the dinghy 36.

Figure 1A:
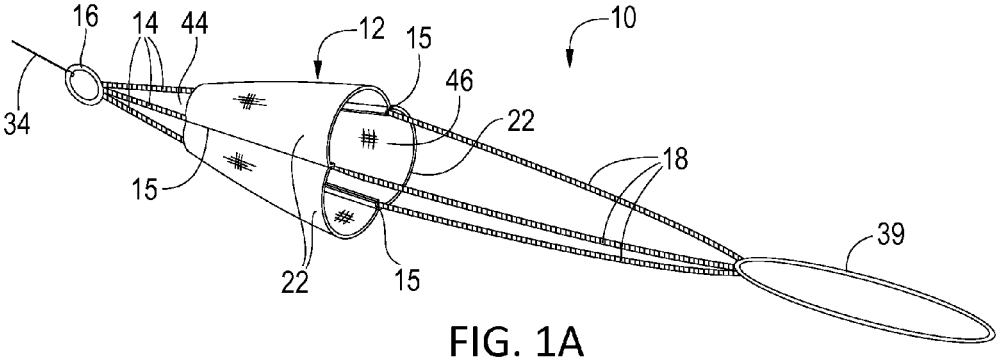
FIG. 1A is a perspective view of an alternative embodiment of the present invention.
Figure 5:
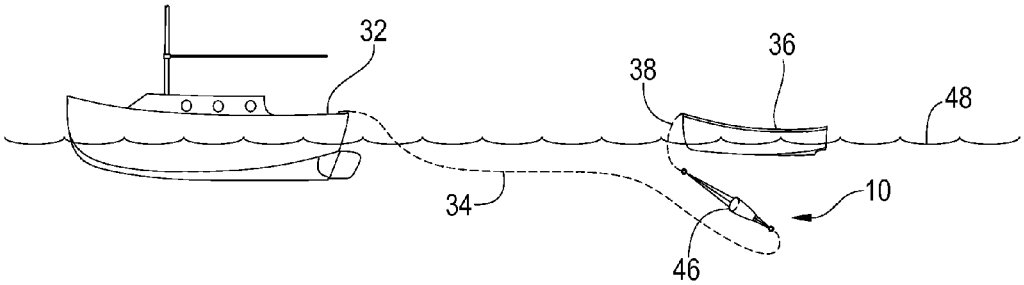
FIG. 5 is an illustration of the present invention in operative connection wherein the towing boat has stopped and the cone is beginning to open underwater.
Figure 6:
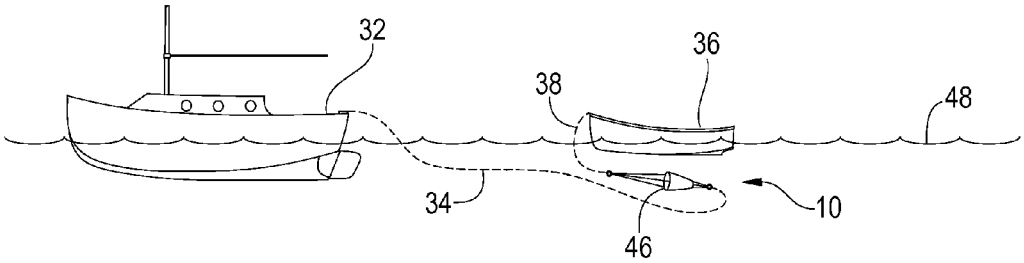
FIG. 6 is an illustration of the present invention in operative connection wherein the towing boat has stopped and the cone has opened underwater.

Turning to FIG. 1A, therein is shown an alternative embodiment of the present invention 10 showing all elements just as in FIG. 1; however, also shown is an alternative towing line loop 39 which replaces item 38 as shown in FIGS. 4-7. Loop 39 is an alternative way to connect the present invention 10 to the dinghy so that the length of the towing line can be easily varied and attached to the bow of the dinghy using a cow hitch type knot by simply passing the end of the loop 39 through a receiving ring on the bow of the dinghy and then passing the present invention 10 back through the end of the loop to form a conventional cow hitch type knot frequently used by sailors. Loop 39 can be made in various lengths so that the braking member 12 can always be maintained about amidships under the dinghy 36 as shown in FIG. 6. Otherwise, the present invention 10 as shown in FIG. 1A is the same as shown in FIG. 1.

Figure 2:
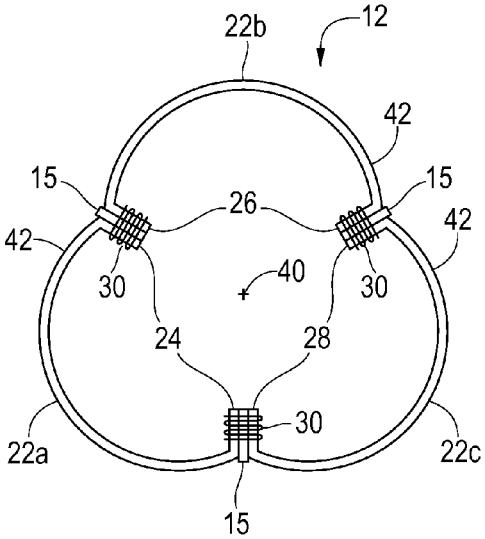
FIG. 2 is a cross sectional view of the present invention taken from FIG. 1 as indicated.

Turning to FIG. 2, therein is shown a cross section of the cone 12 taken from FIG. 1 as indicated showing individual panels 22*a*, 22*b*, 22*c* wherein each of the panels has a concave area 42 easily seen in cross section which is concave relative to the centerline or axis 40 of the cone 12. The concavity shown at areas 42 is due to the panel 22*a* being sewn so that its edge seams 28 attach to a cord 14 and the edge seams 26 of panel 22*b* attach to the cord 14 and the edge seams 28 of panel 22*c* attach the cord 14 so that a cord 14 is disposed between each of the edge seams of the corresponding panels 22*a*, 22*b*, 22*c*; stitching 30 is also shown passing through each of the seams and cords. The concave areas 42 is caused by the unique manner in which the edge seams of panels 22*a*, 22*b*, 22*c* are sewn to cords 14 and results due to the effective stiffness of the fabric from which the panels are expected to be constructed. The concave areas 42 are a result of the edge seams 24, 26, 28 being sewn at a sharp angle, approaching perpendicular, to the surface of the panel 22*a*, 22*b*, 22*c* extending between the edge seams which, due to the effectively stiff fabric or material of construction, causes the surfaces of the panels between the edge seams to flex outwardly and become concave with respect to centerline 40.

Figure 3:
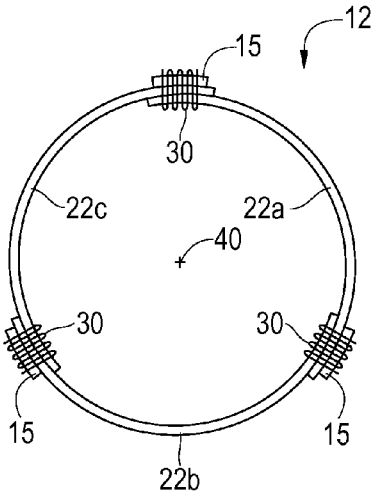
FIG. 3 Prior Art
FIG. 3 is a cross sectional view of a prior art device taken from a position similar to that indicated in FIG. 1.

Turning to FIG. 3, therein is shown a cross sectional area of a related art cone 12 wherein the panels 22*a*, 22*b*, 22*c* have overlapping seams wherein the cords 14 are each disposed on the outside of the seams and are connected with stitching 30. As can be seen, it is believed there are no concave areas created with respect to the axis 40 which causes the panels 22*a*, 22*b*, 22*c* to easily collapse in the water.

Turning generally to FIGS. 4-7, in a towing situation, tension on the line 34 causes the present invention 10 to collapse cone 12 and the present invention 10 rises out of the water, but when the boat 32 slows or stops suddenly, the present invention 10 falls into the water and is overtaken by the dinghy 36, reversing its orientation to the direction of movement of the dinghy 36 and the fabric cone 12 fills with water like a parachute to increase hydraulic resistance and slows and stops the dinghy. When the boat 32 starts moving forward again the fabric cone 12 collapses because the boat is attached to the small end 44 of the cone 12.

Turning to FIG. 4, therein is shown a towing situation wherein the towing boat 32 is connected to the present invention 10 using towing line 34 and the dinghy 36 is connected to the rear of the present invention 10 using towing line 38. FIG. 4 illustrates the situation wherein the towing vessel 32 is towing the dinghy 36 in a forward direction (smaller end 44 in front) with the present invention 10 raised above the water surface 48 because lines 34, 38 are taunt.

Turning to FIG. 5, therein is shown the towing boat 32, the boat towing line 34, the dinghy 36, water 48, the dinghy towing line 38 and the present invention 10 wherein the towing boat 32 has either slowed or stopped in the water 48 and the present invention 10 has become submerged and its larger end 46 has begun to enlarge and fill with water with lines 34, 38 relaxed. This action results because line 38 is shorter than line 34.

Turning to FIG. 6, therein is shown the towing boat 32, the vessel towing line 34, the dinghy 36 and the dinghy towing line 38 along with the present invention 10 underwater wherein the larger end of the present invention 10 has fully opened so that it is now acting as a brake or de-accelerator to prevent the dinghy 36 from colliding or overtaking the towing boat 32 with lines 34, 38 relaxed. This action results because line 38 is shorter than line 34. As illustrated, the present invention 10 seems to work better when its larger end 46 is located at about amidships of the towed boat 36.

Figure 7:
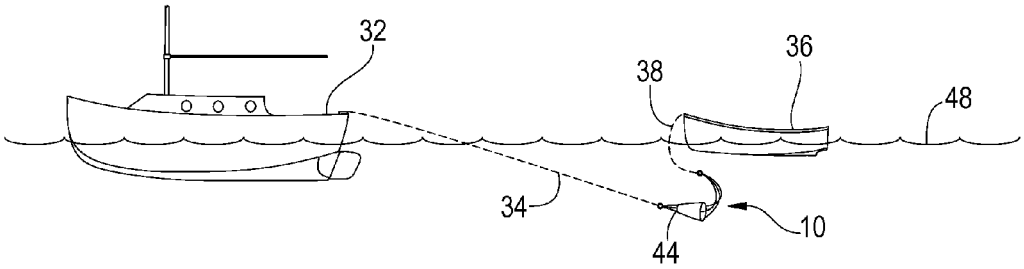
FIG. 7 is an illustration of the present invention in operative connection wherein the towing boat has begun to move forward again and the cone is oriented with its smaller end forward.

Turning to FIG. 7, therein is shown the towing boat 32, the boat towing line 34, the dinghy 36 and the dinghy towing line 38 along with the present invention 10 wherein the towing boat 32 has begun to move forward and tighten the boat towing line 34 and begun to pull on the smaller end 44 of the present invention 10 so that again it is moving easily through the water 48 with its smaller end 44 oriented forwardly.

A boat and dinghy have been previously referred to herein to simplify the discussion, but the present invention 10 could be used in a situation where the towing boat was smaller than the towed boat or dinghy.

Furthermore, while the previous discussion is applicable to recreational craft, the present invention 10 could be built on a larger scale and could have value as a safety device in the towing of large commercial vessels such as barges and ships. The present invention 10 could prevent a tug from being run over by the large commercial vessel it is towing should the tug run aground or lose power.

The size of the present invention 10 would be proportional to the size of the boat being towed and would be as effectively strong as necessary to tow the boat selected to be towed. The length of the device 10 is expected to be from one-fourth to one-third the length of the boat being towed or about 3-4 feet long relative to a typical dinghy which is usually 10-14 feet long. It is expected that the size of the fabric cone braking member 12 in length could be up to about one-third the length of the present invention 10 and the diameter of the cone would be slightly larger than the length of the cone.

By way of summary and with reference to FIGS. 1-7, the present invention 10 provides braking for a first towed boat 36 being towed behind a second towing boat 32 on a water surface 48 including a plurality of cords 15, each the cords having a first end 16 oriented toward the towing boat and a second end 20 oriented toward the towed boat, a braking member 12 interposed in the plurality of cords, wherein the plurality of cords lie along the periphery of the braking member, wherein the braking member has the shape of a truncated cone having a smaller diameter end 44 and a larger diameter end 46, wherein the smaller diameter end is oriented toward the first end of the plurality of cords and the larger diameter end is oriented toward the second end of the plurality of cords, a longer tow line 34 and a shorter tow line 38, wherein the longer tow line connects the towing boat to the first end of the plurality of cords and the shorter tow line connects the towed boat to the second end of the plurality of cords to permit the towed boat to be towed behind the towing boat. Further, wherein the smaller diameter end of the braking member is oriented toward the towing boat when the towing boat is moving forward so that the braking member is disposed above the water surface. Further, wherein the shorter tow line orients the larger diameter end of the braking member toward the towed boat providing greater hydraulic resistance when the towing boat is stopped as the braking member sinks below the water surface. Further, the braking member including a plurality of panels 22 disposed between each pair of cords so that the number of panels equals the number of cords, wherein the panels are configured so that each panel has a concave shape shown at 42 with respect to a centerline of the braking member so that the panel retains its concave shape without collapsing when below the water surface.

I claim:

1. An apparatus for braking a towed boat being towed behind a towing boat on a water surface, comprising:

a) a plurality of cords, each said cord having a first end oriented toward the towing boat and a second end oriented toward the towed boat;

b) a braking member, said braking member interposed in said plurality of cords, wherein said plurality of cords lie along the periphery of said braking member;

c) wherein said braking member has the shape of a truncated cone, said braking member having a smaller diameter end and a larger diameter end, wherein said smaller diameter end is oriented toward said first end of said plurality of cords and said larger diameter end is oriented toward said second end of said plurality of cords;

d) a longer tow line and a shorter tow line; and, e) wherein said longer tow line connects the towing boat to said first end of said plurality of cords and said shorter tow line connects the towed boat to said second end of said plurality of cords to permit the towed boat to be towed behind the towing boat and the towed boat to be braked when the towing boat stops.

2. The apparatus of claim 1, wherein said smaller diameter end of said braking member is oriented toward the towing boat when the towing boat is moving forward so that said braking member is disposed above the water surface.

3. The apparatus of claim 1, wherein said shorter tow line orients said larger diameter end of said braking member toward the towed boat providing greater hydraulic resistance when the towing boat is stopped as said braking member sinks below the water surface.

4. The apparatus of claim 1, said braking member further comprising a plurality of panels, wherein a panel is disposed between each pair of cords so that the number of panels equals the number of cords, wherein said panels are configured so that each panel has a concave shape with respect to a centerline of said braking member so that said panel retains its concave shape without collapsing when below the water surface.

5. The apparatus of claim 1, wherein there are three cords.

6. The apparatus of claim 1, wherein said braking member comprises fabric.

7. The apparatus of claim 1, wherein each said cord is an elongated flexible member.

8. A method for braking a towed boat being towed behind a towing boat on a water surface, comprising the steps of:

a) providing a plurality of cords each having a first end joined together and oriented toward the towing boat and a second end joined together and oriented toward the towed boat;

b) disposing a braking member in the plurality of cords so that the plurality of cords lie along the periphery of the braking member;

c) shaping the braking member as a truncated cone having a smaller diameter end and a larger diameter end, and, orienting the smaller diameter end toward the first end of the plurality of cords and orienting the larger diameter end toward the second end of the plurality of cords;

d) providing a longer tow line and a shorter tow line; and, e) connecting the towing boat to the first end of the plurality of cords using the longer tow line and connecting the towed boat to the second end of the plurality of cords using the shorter tow line so that the towed boat can be towed behind the towing boat and the towed boat can be braked when the towing boat stops.

9. The method of claim 8, further comprising the step of orienting the smaller diameter end of the braking member toward the towing boat when the towing boat is moving forward so that the braking member is disposed above the water surface.

10. The method of claim 8, further comprising the step of the shorter tow line orienting the larger diameter end of the braking member toward the towed boat when the towing boat is stopped as the braking member sinks below the water surface thereby providing greater hydraulic resistance due to expansion of the larger diameter end of the braking member.

11. The apparatus of claim 8, further comprising the step of providing a plurality of panels on the braking member so that a panel is disposed between each pair of cords so that the number of panels equals the number of cords, wherein the panels are configured so that each panel has a concave shape with respect to a centerline of the braking member so that the panel retains its concave shape without collapsing when below the water surface.

12. The method of claim 8, further comprising the step of providing three cords.

13. The method of claim 8, wherein the braking member comprises fabric.

14. The method of claim 8, wherein each cord is an elongated flexible member.

15. The apparatus of claim 1, wherein said shorter tow line is a loop to permit the length of the loop to be varied so that the braking member is amidships of the towed boat when the braking member is underwater.

16. The method of claim 8, further comprising the step of forming the shorter tow line into a loop.

17. The method of claim 16, further comprising the step of varying the length of the loop so that the braking member is amidships of the towed boat when the braking member is underwater.

* * * * *